US011274517B2

(12) United States Patent
Tenorio et al.

(10) Patent No.: US 11,274,517 B2
(45) Date of Patent: Mar. 15, 2022

(54) ROTATING CONTROL DEVICE SYSTEM WITH RAMS

(71) Applicant: Cameron International Corporation, Houston, TX (US)

(72) Inventors: Harold Tenorio, Houston, TX (US); Jon Tyler, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/885,356

(22) Filed: May 28, 2020

(65) Prior Publication Data

US 2021/0372222 A1 Dec. 2, 2021

(51) Int. Cl.
*E21B 33/08* (2006.01)
*E21B 33/06* (2006.01)

(52) U.S. Cl.
CPC ..... *E21B 33/085* (2013.01); *E21B 33/062* (2013.01)

(58) Field of Classification Search
CPC ..... E21B 33/061; E21B 33/062; E21B 33/085
See application file for complete search history.

(56) References Cited

U.S. PATENT DOCUMENTS 2,207,149 A * 7/1940 Hild ..... E21B 33/085 175/210
4,488,703 A * 12/1984 Jones ..... E21B 33/062 251/77
6,352,129 B1 3/2002 Best
6,575,244 B2 6/2003 Chang et al.
6,904,981 B2 6/2005 van Riet
7,004,448 B2 2/2006 Suter et al.
7,165,610 B2 1/2007 Hopper
7,185,719 B2 3/2007 van Riet
7,350,597 B2 4/2008 Reitsma et al.
7,478,672 B2 1/2009 Rogers et al.
7,487,837 B2 2/2009 Bailey et al.
7,828,081 B2 11/2010 Reitsma
7,866,399 B2 1/2011 Kozicz et al.
8,096,711 B2 1/2012 Beauchamp et al.
8,286,734 B2 10/2012 Hannegan et al.
8,413,724 B2 4/2013 Carbaugh et al.
8,567,525 B2 10/2013 Reitsma
8,573,294 B2 11/2013 Struthers et al.
8,596,345 B2 12/2013 Li et al.
8,631,874 B2 1/2014 Kozicz et al.
(Continued)

FOREIGN PATENT DOCUMENTS

EP 0261629 A2 3/1988
GB 2135717 A * 9/1984 ..... E21B 33/062
(Continued)

*Primary Examiner* — Jennifer H Gay
(74) *Attorney, Agent, or Firm* — Kelly McKinney

(57) ABSTRACT

A rotating control device (RCD) system includes a housing having a bore, a first ram assembly supported in the housing, and a second ram assembly supported within the housing. The first ram assembly includes a first ram and a first packer coupled to the first ram, and the second ram assembly includes a second ram and a second packer coupled to the second ram. The RCD system also includes a bearing assembly configured to enable the first packer and the second packer to rotate relative to the first ram and the second ram.

18 Claims, 9 Drawing Sheets

(56) References Cited

U.S. PATENT DOCUMENTS

| | | | | |
|---|---|---|---|---|
| 8,726,983 | B2 | 5/2014 | Khan | |
| 8,757,272 | B2 | 6/2014 | Couturier et al. | |
| 8,820,747 | B2 | 9/2014 | Zubia et al. | |
| 8,844,633 | B2 | 9/2014 | Reitsma et al. | |
| 9,038,729 | B2 | 5/2015 | Leduc et al. | |
| 9,109,405 | B2 | 8/2015 | Carbaugh et al. | |
| 9,109,420 | B2 | 8/2015 | Tindle et al. | |
| 9,151,135 | B2 | 10/2015 | Eriksen | |
| 9,228,433 | B2 | 1/2016 | Sawyer et al. | |
| 9,284,811 | B2 | 3/2016 | Michaud et al. | |
| 9,328,574 | B2 | 5/2016 | Sehsah | |
| 9,341,037 | B2 | 5/2016 | Suter | |
| 9,388,650 | B2 | 7/2016 | Leuchtenberg | |
| 9,429,007 | B2 | 8/2016 | Reitsma et al. | |
| 2004/0113108 | A1* | 6/2004 | Ward | E21B 33/062 251/1.3 |
| 2009/0057024 | A1* | 3/2009 | Williams | E21B 33/085 175/195 |
| 2012/0241163 | A1 | 9/2012 | Reitsma et al. | |
| 2014/0048331 | A1 | 2/2014 | Boutalbi et al. | |
| 2014/0209316 | A1 | 7/2014 | Tindle et al. | |
| 2014/0216751 | A1 | 8/2014 | Liezenberg | |
| 2014/0262313 | A1 | 9/2014 | Gilmore et al. | |
| 2015/0034384 | A1 | 2/2015 | Leuchtenberg | |

FOREIGN PATENT DOCUMENTS

| | | | |
|---|---|---|---|
| WO | 2007047800 | A2 | 4/2007 |
| WO | 2010082831 | A1 | 7/2010 |
| WO | 2012035001 | A2 | 3/2012 |
| WO | 2014087371 | A1 | 6/2014 |

* cited by examiner

ROTATING CONTROL DEVICE SYSTEM WITH RAMS

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources have a profound effect on modern economies and societies. In order to meet the demand for such natural resources, numerous companies invest significant amounts of time and money in searching for, accessing, and extracting oil, natural gas, and other natural resources. Particularly, once a desired natural resource is discovered below the surface of the earth, drilling systems are often employed to access the desired natural resource. These drilling systems can be located onshore or offshore depending on the location of the desired natural resource. Such drilling systems may include a drilling fluid system configured to circulate drilling fluid into and out of a wellbore to facilitate drilling the wellbore.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
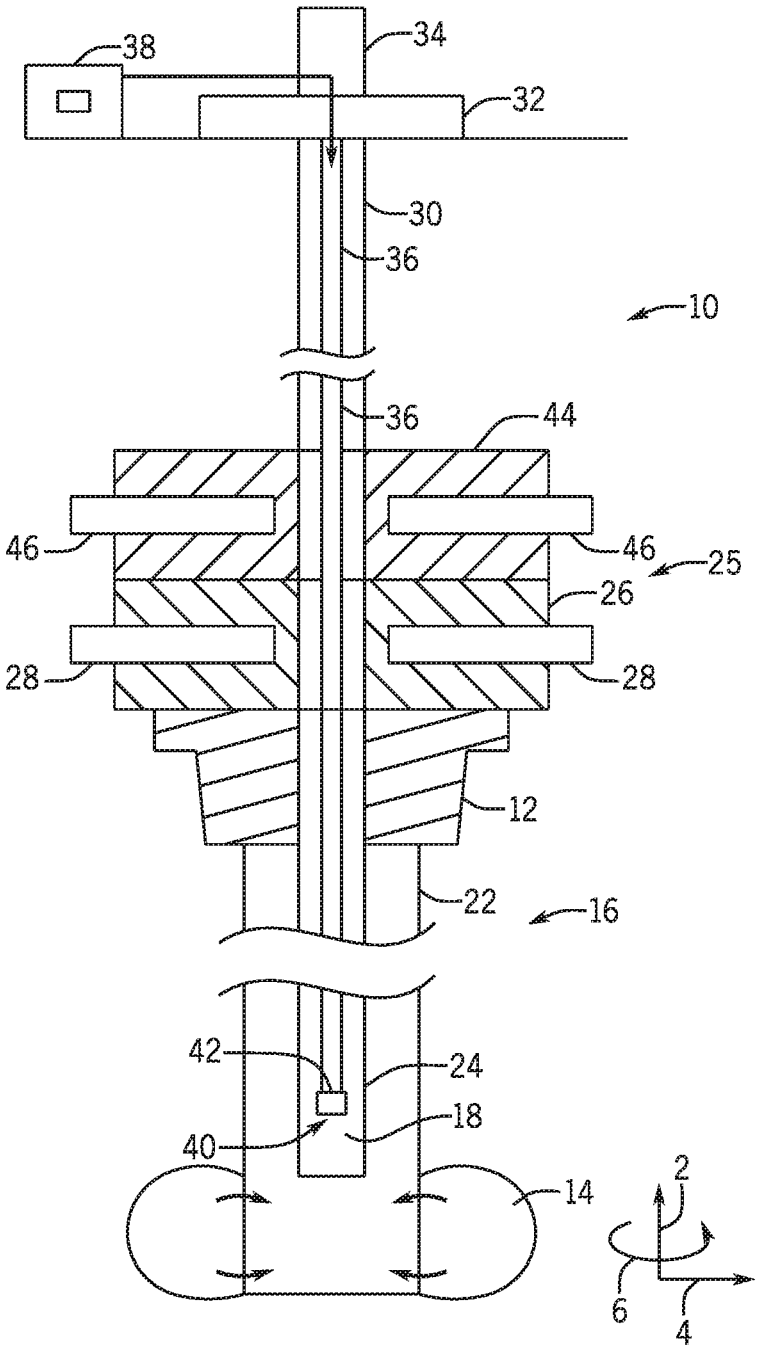
FIG. 1 is a schematic diagram of a drilling system, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," "said," and the like, are intended to mean that there are one or more of the elements. The terms "comprising," "including," "having," and the like are intended to be inclusive and mean that there may be additional elements other than the listed elements. The use of "top," "bottom," "above," "below," and variations of these terms is made for convenience, but does not require any particular orientation of the components relative to some fixed reference, such as the direction of gravity. The term "fluid" encompasses liquids, gases, vapors, and combinations thereof. Numerical terms, such as "first," "second," and "third" may be used to distinguish components to facilitate discussion, and it should be noted that the numerical terms may be used differently or assigned to different elements in the claims. The drawing figures are not necessarily to scale. Certain features and components herein may be shown exaggerated in scale and/or in somewhat schematic form. Some details may not be shown in the interest of clarity and conciseness.

As set forth above, a drilling system may include a drilling fluid system that is configured to circulate drilling fluid into and out of a wellbore to facilitate drilling the wellbore. For example, the drilling fluid system may provide a flow of the drilling fluid through a drill string as the drill string rotates a drill bit that is positioned at a distal end portion of the drill string. The drilling fluid may exit through one or more openings at the distal end portion of the drill string and may return toward a platform of the drilling system via an annular space between the drill string and a casing that lines the wellbore.

In some cases, the drilling system may use managed pressure drilling ("MPD"). MPD regulates a pressure and a flow of the drilling fluid within the drill string so that the flow of the drilling fluid does not over pressurize a well (e.g., expand the well) and/or blocks the well from collapsing under its own weight. The ability to manage the pressure and the flow of the drilling fluid enables use of the drilling system to drill in various locations, such as locations with relatively softer sea beds.

The drilling system of the present disclosure may include a rotating control device (RCD) system. The RCD system may include a housing that defines a bore, and the drill string may extend through the bore during drilling operations. The RCD system may also include a seal element that is configured to seal against the drill string to thereby block a fluid flow (e.g., the drilling fluid, cuttings, and/or natural resources [e.g., carbon dioxide, hydrogen sulfide]) from passing across the seal element of the RCD system from the well toward the platform. The seal element may be coupled to rams (e.g., opposed rams) that are configured to move the seal element into and out of the bore to adjust the RCD system between an open configuration in which the seal element does not seal against the drill string and a closed configuration in which the seal element seals against the drill string. While the seal element is in the closed configuration, the fluid flow may be diverted toward another suitable location (e.g., a collection tank) other than the platform.

With the foregoing in mind, FIG. 1 is a schematic diagram that illustrates an embodiment of a drilling system 10 that is configured to carry out drilling operations. The drilling system 10 may be a subsea system, although the disclosed embodiments may be used in a land-based (e.g., surface) system. The drilling system 10 may use MPD techniques. As illustrated, the drilling system 10 includes a wellhead assembly 12 coupled to a mineral deposit 14 via a well 16 having a wellbore 18.

The wellhead assembly 12 may include or be coupled to multiple components that control and regulate activities and conditions associated with the well 16. For example, the wellhead assembly 12 generally includes or is coupled to pipes, bodies, valves, and seals that enable drilling of the well 16, route produced minerals from the mineral deposit 14, provide for regulating pressure in the well 16, and provide for the injection of drilling fluids into the wellbore 18. A conductor 22 may provide structure for the wellbore 18 and may block collapse of the sides of the well 16 into the wellbore 18. A casing 24 may be disposed within the conductor 22. The casing 24 may provide structure for the wellbore 18 and may facilitate control of fluid and pressure during drilling of the well 16. The wellhead assembly 12 may include a tubing spool, a casing spool, and a hanger to enable installation of the casing 24. As shown, the wellhead assembly 12 may include or may be coupled to a blowout preventer (BOP) assembly 25 (e.g., BOP stack), which may include one or more ram BOPs 26. For example, the BOP assembly 25 shown in FIG. 1 includes at least one ram BOP 26 having moveable rams 28 (e.g., shear rams; pipe rams) configured to seal the wellbore 18.

A drilling riser 30 may extend between the BOP assembly 25 and a platform 32. The platform 32 may include various components that facilitate operation of the drilling system 10, such as pumps, tanks, and power equipment. The platform 32 may also include a derrick 34 that supports a tubular 36 (e.g., drill string), which may extend through the drilling riser 30. A drilling fluid system 38 may direct the drilling fluid into the tubular 36, and the drilling fluid may exit through one or more openings at a distal end portion 40 of the tubular 36 and may return (along with cuttings and/or other substances from the well 16) toward the platform 32 via an annular space (e.g., between the tubular 36 and the casing 24 that lines the wellbore 18; between the tubular 36 and the drilling riser 30). A drill bit 42 may be positioned at the distal end portion 40 of the tubular 36. The tubular 36 may rotate within the drilling riser 30 to rotate the drill bit 42, thereby enabling the drill bit 42 to drill and form the well 16.

As shown, the drilling system 10 may include a rotating control device (RCD) system 44 that is configured to form a seal across and/or to block fluid flow through the annular space that surrounds the tubular 36. For example, the RCD system 44 may be configured to block the drilling fluid, cuttings, and/or other substances from the well 16 from passing across a seal element of the RCD system 44 toward the platform 32. The RCD system 44 may include moveable ram assemblies 46 that operate to move the seal element relative to the tubular 36. The RCD system 44 may be positioned at any suitable location within the drilling system 10, such as any suitable location between the wellbore 18 and the platform 32. For example, as shown, the RCD system 44 may positioned between the BOP assembly 25 and the platform 32. In some embodiments, the RCD system 44 may be included within the BOP assembly 25 (e.g., one or more ram BOPs 26 and components of the RCD system 44 may be within a housing of the BOP assembly 25; one or more ram BOPs 26 and the RCD system 44 may be stacked vertically within the housing of the BOP assembly 25).

In operation, the tubular 36 may be rotated about and/or moved along a vertical axis 2 to enable the drill bit 42 to drill the well 16. As discussed in more detail below, the RCD system 44 may be controlled to provide a seal against the tubular 36 even as the tubular 36 moves within the drilling riser 30. The drilling system 10 and its components may be described with reference to the vertical axis 2 (or vertical direction), a longitudinal axis 4 (or longitudinal direction), and a circumferential axis 6 (or direction) to facilitate discussion.

Figure 2:
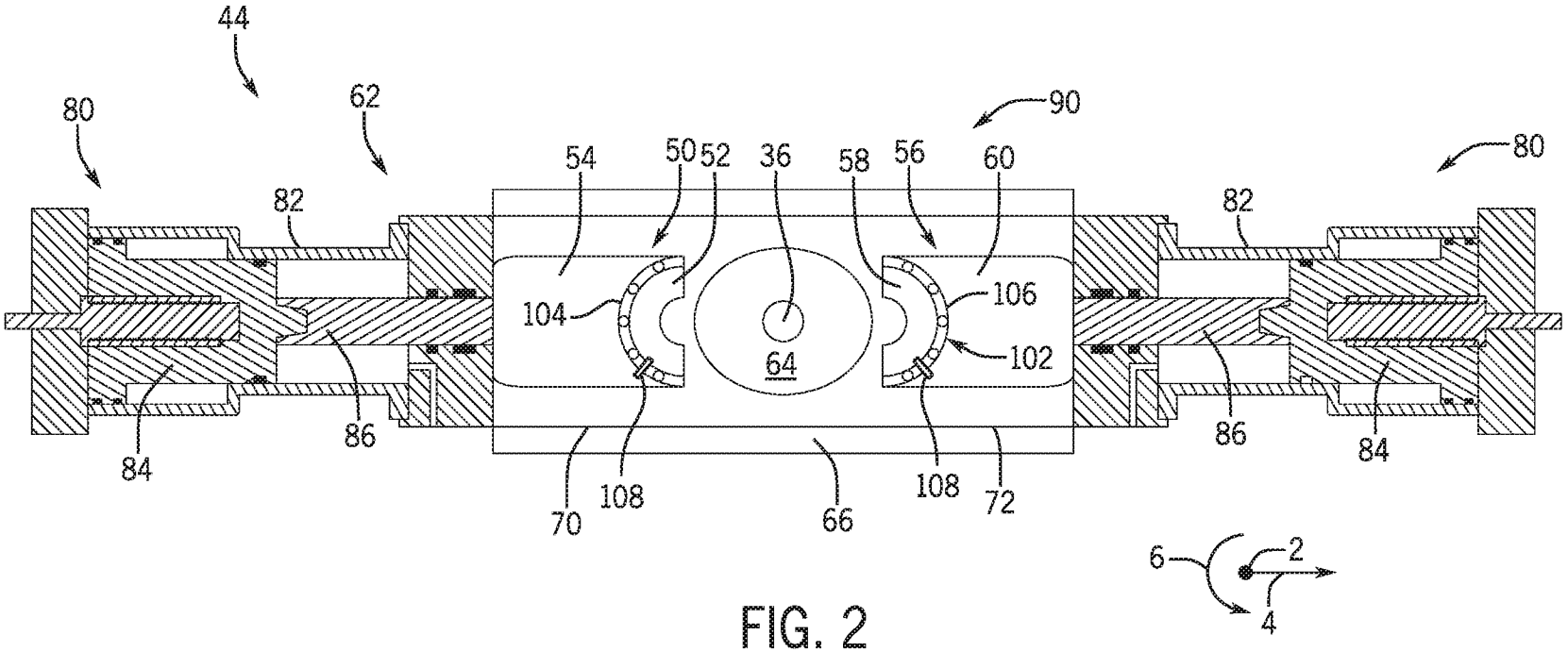
FIG. 2 is a cross-sectional top view of a rotating control device (RCD) system that may be used in the drilling system of FIG. 1, wherein the RCD system is in an open configuration, in accordance with an embodiment of the present disclosure.

FIG. 2 is a cross-sectional top view of the RCD system 44. As shown, the RCD system 44 includes a first ram assembly 50 having a first packer 52 (e.g., seal element portion; elastomer seal) coupled to a first ram 54 (e.g., ram body; metal body) and a second ram assembly 56 having a second packer 58 (e.g., seal element portion; elastomer seal) coupled to a second ram 60 (e.g., ram body; metal body). In FIG. 2, the RCD system 44 is in an open configuration 62 (e.g., default configuration) in which the first ram assembly 50 and the second ram assembly 56 are withdrawn or retracted from a bore 64 (e.g., central bore) of the RCD system 44, do not contact the tubular 36, and/or do not contact one another.

The RCD system 44 includes a housing 66 (e.g., body) surrounding the bore 64. The housing 66 also defines a first cavity 70 that supports the first ram assembly 50 and a second cavity 72 that supports the second ram assembly 56. A central axis of the bore 64 extends along the vertical axis 2, while a central axis of the first cavity 70 and the second cavity 72 extends along the longitudinal axis 4 and is transverse (e.g., orthogonal) to the central axis of the bore 64. Thus, as the first ram assembly 50 and the second ram assembly 56 move (e.g. slide) within the first cavity 70 and the second cavity 72, respectively, the first ram assembly 50 and the second ram assembly 56 move along the longitudinal axis 4 into and out of the bore 64.

The housing 66 is generally rectangular in the illustrated embodiment, although the housing 66 may have any cross-sectional shape, including any polygonal shape or an annular shape. A plurality of bonnet assemblies 80 are mounted to the housing 66 (e.g., via threaded fasteners). In the illustrated embodiment, first and second bonnet assemblies 80 are mounted to opposite sides of the housing 66. Each bonnet assembly 80 supports an actuator 82 (e.g., actuator assembly), which may include a piston 84 and a connecting rod 86. In the open configuration 62, the first ram assembly 50 is generally adjacent to a first end of the housing 66 and the second ram assembly 56 is generally adjacent to a second end 88, opposite the first end along the longitudinal axis 4, of the housing 66. As shown, in the open configuration 62, the first ram assembly 50 and the second ram assembly 56 are on opposite sides of the bore 64 along the longitudinal axis 4. Then, in operation, the actuators 82 may drive the first ram assembly 50 and the second ram assembly 56 toward one another along the longitudinal axis 4 and through the bore 64 to contact the tubular 36 to seal the bore 64 to reach a closed configuration.

The first packer 52 and the second packer 58 may together form a seal element 90 that is configured to form an annular seal about the tubular 36 within the bore 64 at least while the first ram assembly 50 and the second ram assembly 56 are in the closed configuration. The first packer 52 and the second packer 58 may each have an arc cross-sectional shape (e.g., 180 degree arc). For example, the first packer 52 and the second packer 58 may each have a semicircular cross-sectional shape with a curved central groove (e.g., semicircular groove or cut-out portion) that is configured to receive and to seal about a half of the tubular 36. Thus, when the first ram assembly 50 and the second packer assembly 56 are driven into the bore 64, the respective ends of the first packer 52 and the second packer 58 contact one another, and the first packer 52 and the second packer 58 form the annular seal about the tubular 36.

Figure 3:
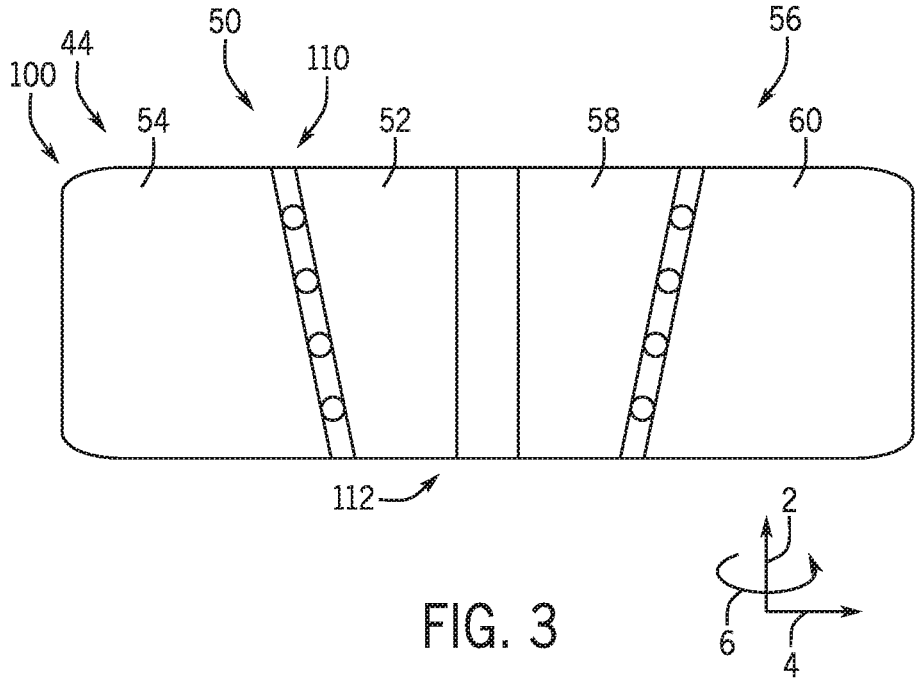
FIG. 3 is a cross-sectional top view of a portion of the RCD system of FIG. 2, wherein the RCD system is in a closed configuration, in accordance with an embodiment of the present disclosure.

FIG. 3 is a is a cross-sectional top view of a portion of the RCD system 44 of FIG. 2, wherein the RCD system is in a closed configuration 100. In the closed configuration 100, the first ram assembly 50 and the second ram assembly 56 are positioned within the bore 64, contact the tubular 36, and/or contact one another. In particular, the respective ends of the first packer 52 and the second packer 58 contact one another, and the first packer 52 and the second packer 58 form the annular seal about the tubular 36. As shown, the first ram 54 and the second ram 60 may have corresponding curvatures (e.g., curved surfaces facing the first packer 52 and the second packer 58, respectively). The RCD system 44 may be adjusted from the open configuration 62 of FIG. 2 to the closed configuration 100 of FIG. 3 (and vice versa) via operation of the actuators 82 of FIG. 2 (e.g., by providing a hydraulic fluid to drive the pistons 84).

As shown in FIGS. 2 and 3, the RCD system 44 may include a bearing assembly 102. In particular, the first ram assembly 50 may include a first bearing 104 (e.g., first bearing portion; curved bearing portion) of the bearing assembly 102, and the second ram assembly 56 may include a second bearing 106 (e.g., second bearing portion; curved bearing portion) of the bearing assembly 102. The first bearing 104 may be positioned between (e.g., radially between) a radially-inner curved surface of the first ram 54 and a radially-outer curved surface of the first packer 52, and the second bearing 106 may be positioned between (e.g., radially between) a radially-inner curved surface of the second ram 60 and a radially-outer curved surface of the second packer 58. When the first ram assembly 50 and the second ram assembly 56 are driven into the bore 64, the respective ends of the first bearing 104 and the second bearing 106 contact one another to form an annular bearing structure that enables rotation of the seal element 90 (e.g., formed by the first packer 52 and the second packer 58) relative to the first ram 54 and the second ram 60. Thus, while the RCD system 44 is in the closed configuration 100 in which the seal element 90 seals against the tubular 36, the seal element 90 may rotate with the tubular 36 (e.g., be driven to rotate via rotation of the tubular 36). In some embodiments, the bearing assembly 102 may be used with or may be replaced by lubricant applied between the curved surfaces, and the lubricant may enable the rotation of the seal element 90. The first packer 52 and the second packer 58 may rotate together in the circumferential direction 6. Thus, at certain times during the rotation, the first packer 52 may rotate to be positioned between the second ram 60 and the second packer 58 along the longitudinal axis 4, while the second packer 58 may rotate to be positioned between the first ram 54 and the first packer 52. For example, at certain times during the rotation, the first packer 52 and the second packer 58 may change or swap places as compared to the places shown in FIG. 2 and may rotate continuously in the circumferential direction 6.

In some embodiments, the RCD system 44 may include one or more retaining features 108 that are configured to block rotation of the first packer 52 relative to the first ram 54 and to block rotation of the second packer 58 relative to the second ram 60. The one or more retaining features 108 may include one or more shear pins that extend radially between the first packer 52 and the first ram 54 and one or more shear pins that extend radially between the second packer 58 and the second ram 60. The one or more shear pins may block the rotation of the first packer 52 and the second packer 58 until the first packer 52 and the second packer 58 seal against the tubular 36 as the tubular 36 rotates. Then, the one or more shear pins may break due to the rotational force exerted by the tubular 36 on the first packer 52 and the second packer 58 as the tubular 36 rotates. Once the one or more shear pins break, the first packer 52 and the second packer 58 may rotate with the tubular 36 as the tubular 36 rotates.

In some embodiments, the one or more retaining features 108 may include one or more actuatable locks that may extend radially between the first packer 52 and the first ram 54 and one or more actuatable locks that extend radially between the second packer 58 and the second ram 60. The one or more actuatable locks may block the rotation until adjusted (e.g., from a locked configuration to an unlocked configuration; via electronic control by an electronic controller) so as not to extend radially between the components in this manner. Then, the first packer 52 and the second packer 58 may rotate with the tubular 36 as the tubular 36 rotates. In some embodiments, the one or more actuatable locks may be adjusted automatically in response to the first ram assembly 50 and the second ram assembly 56 being driven toward and/or reaching the closed configuration 100. In some embodiments, the one or more retaining features 108 (e.g., the actuatable locks) may enable the RCD system 44 to operate to seal about the tubular 36 without rotation of the first packer 52 or the second packer 58 relative to the first ram 54 and the second ram 60 (e.g., the RCD system 44 may operate as a BOP having pipe rams that seal against the tubular 36 without rotation of the first packer 52 or the second packer 58 relative to the first ram 54 and the second ram 60). This may be particularly useful during drilling operations or other types of operations in which the tubular 36 does not rotate within the bore 64; however, this may be useful regardless of whether the tubular 36 rotates within the bore 64. It should be appreciated that the one or more retaining features 108 may have any suitable form to enable the disclosed techniques.

Figure 4:
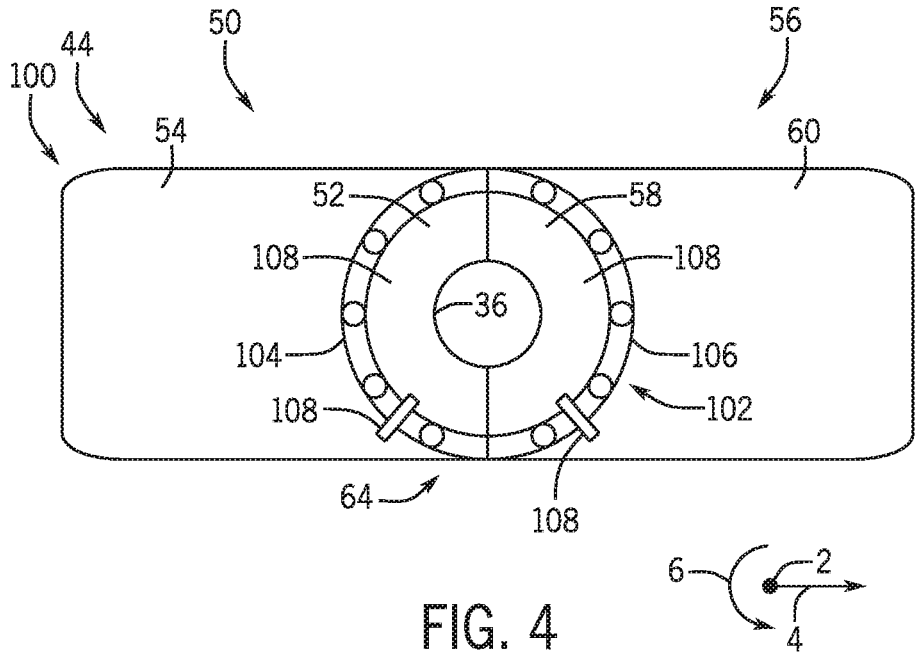
FIG. 4 is a cross-sectional side view of the portion of the RCD system of FIG. 3, wherein the RCD system is in the closed configuration, in accordance with an embodiment of the present disclosure.

FIG. 4 is a cross-sectional side view of the portion of the RCD system 44 of FIG. 3, wherein the RCD system 44 is in the closed configuration 100. As shown, in some embodiments, the radially-inner curved surface of the first ram 54 and the radially-outer curved surface of the first packer 52 may have a corresponding taper. Similarly, the radially-inner curved surface of the first ram 54 and the radially-outer curved surface of the first packer 52 may have a corresponding taper. For example, a vertically-upper end 110 of the radially-inner curved surfaces and the radially-outer curved surfaces may be configured to be positioned further from the bore 64 along the longitudinal axis 4 as compared to a vertically-lower end 112 (e.g., vertically below the vertically-upper end 110 relative to a wellbore and along a gravity vector) of the radially-inner curved surfaces and the curved radially-outer surfaces. As shown, the corresponding taper may be a gradual, continuous taper from the vertically-upper end 110 to the vertically-lower end 112. However, the corresponding taper may only extend along a portion of the interface between the vertically-upper end 110 and the vertically-lower end 112 and/or the corresponding taper may include a stepped interface (e.g., stepped surfaces having alternatively longitudinally-facing and vertically-facing surfaces). The corresponding taper may enable the first ram 54 to provide support to the first packer 52 along the vertical axis 2 and may enable the second ram 58 to provide support to the second packer 58 along the vertical axis 2. Thus, the corresponding taper may retain the first packer 52 within the first ram 54 and may retain the second packer 58 within the second ram 60 (e.g., block the first packer 52 and the second packer 58 from falling or sliding along the vertical axis 2 (e.g., toward the wellbore; due to gravity). Additionally, the corresponding taper may facilitate maintenance operations, such as inspection, repair, or replacement of the first packer 52 and the second packer 58.

In FIGS. 2-4, the first packer 52 and the second packer 58 may be retained on the first ram 54 and the second ram 60, respectively, due to the one or more retaining features 108 and/or the corresponding taper. It is presently recognized that various arrangements of components and/or techniques for assembly of the components may be desirable, such as to facilitate various operations (e.g., maintenance operations; sealing operations) with the RCD system 44 of FIG. 1. With the foregoing in mind, FIGS. 5-9 illustrate various arrangements of components of the RCD system 44 of FIG. 1, as well as techniques for assembly of the components.

Figure 5:
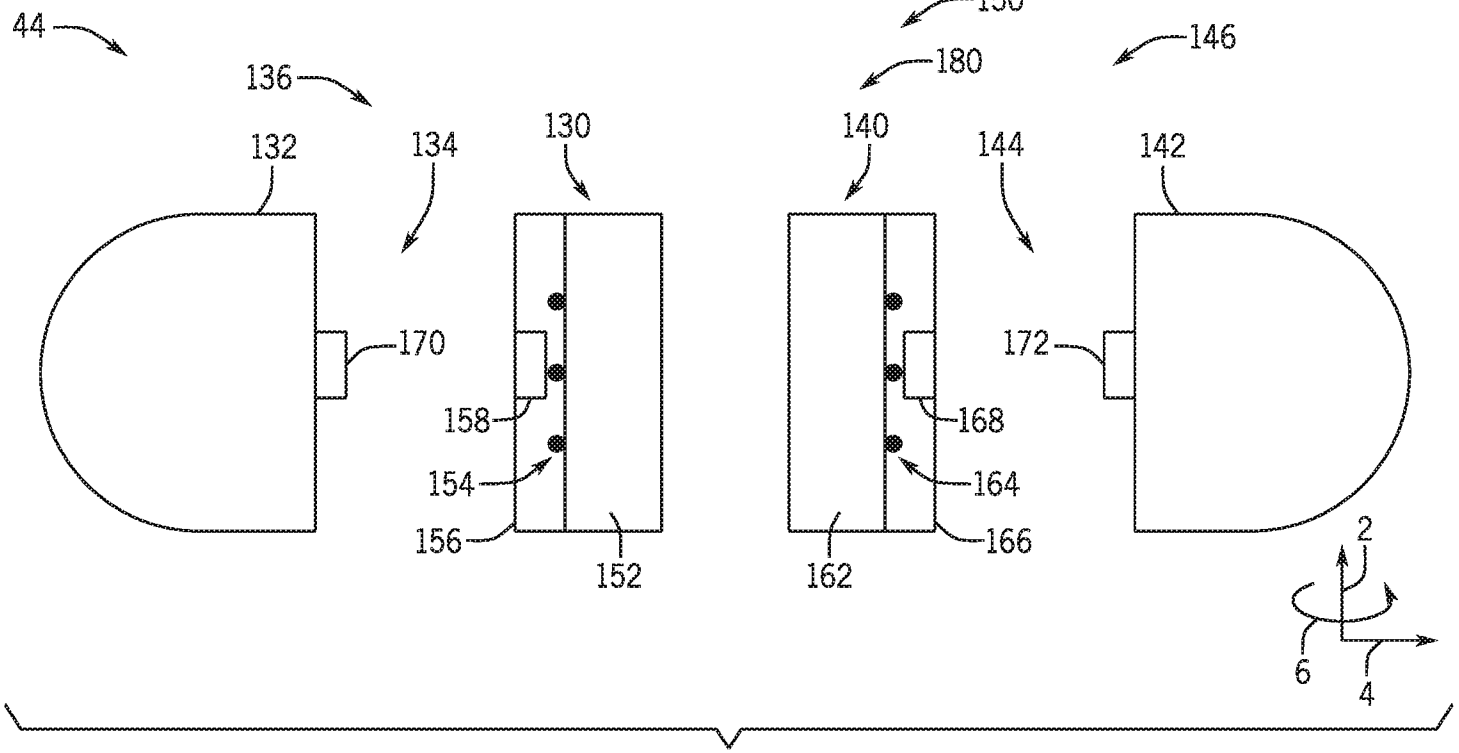
FIG. 5 is a cross-sectional side view of a portion of an RCD system that may be used in the drilling system of FIG. 1, wherein a seal element assembly is in a disengaged configuration, in accordance with an embodiment of the present disclosure.

FIG. 5 is a cross-sectional side view of a portion of the RCD system 44 that may be used in the drilling system 10 of FIG. 1. In FIG. 5, a first packer assembly 130 is configured to couple to a first ram 132 via a first stab connection 134 (e.g., key-slot connection) to form a first ram assembly 136, and a second packer assembly 140 is configured to couple to a second ram 142 via a second stab connection 144 (e.g., key-slot connection) to form a second ram assembly 146. Together, the first packer assembly 130 and the second packer assembly 140 form a seal element assembly 150.

As shown, the first packer assembly 130 includes a first packer 152, a first bearing 154 (e.g., first bearing portion), a frame 156, and a respective stab feature 158. Similarly, the second packer assembly 140 includes a second packer 162, a second bearing 164 (e.g., second bearing portion), a frame 166, and a respective stab feature 168. The first ram 132 may include a respective stab feature 170 that is configured to engage (e.g., via a stab connection) the respective stab feature 158 of the first packer assembly 130, and the second ram 142 may include a respective stab feature 172 that is configured to engage (e.g., via a stab connection) the respective stab feature 168 of the second packer assembly 140. It should be appreciated that multiple stab features and multiple stab connections may be provided between the first packer assembly 130 and the first ram 132 and/or between the second packer assembly 140 and the second ram 142 (e.g., distributed along the circumferential axis 6 and/or the vertical axis 2).

The first packer assembly 130 and the second packer assembly 140 may be assembled onto the first ram 132 and the second ram 142, respectively, during manufacturing operations prior to installation of the RCD system 44 at a wellsite or at the wellsite. For example, to assemble the components at the wellsite, the first packer assembly 130 and the second packer assembly 140 may be lowered into the bore via a tool (e.g., running tool; installation tool) until the first packer assembly 130 and the second packer assembly 140 are aligned with the first ram 132 and the second ram 142 along the vertical axis 2. Once aligned, the first ram 132 and the second ram 142 may be driven (e.g., via actuators) toward the bore to form the stab connections 134, 144 to thereby coupled the first packer assembly 130 to the first ram 132 and the second packer assembly 140 to the second ram 142. Additionally or alternatively, the tool may be configured to drive the first packer assembly 130 and the second packer assembly 140 toward the first ram 132 and the second ram 142, respectively, to form the stab connections 134, 144 to thereby couple the first packer assembly 130 to the first ram 132 and the second packer assembly 140 to the second ram 142. The seal element assembly 150 may be coupled to the first ram 132 and the second ram 142 while the tubular is in the bore or while the tubular is not in the bore (e.g., the bore is empty).

Figure 6:
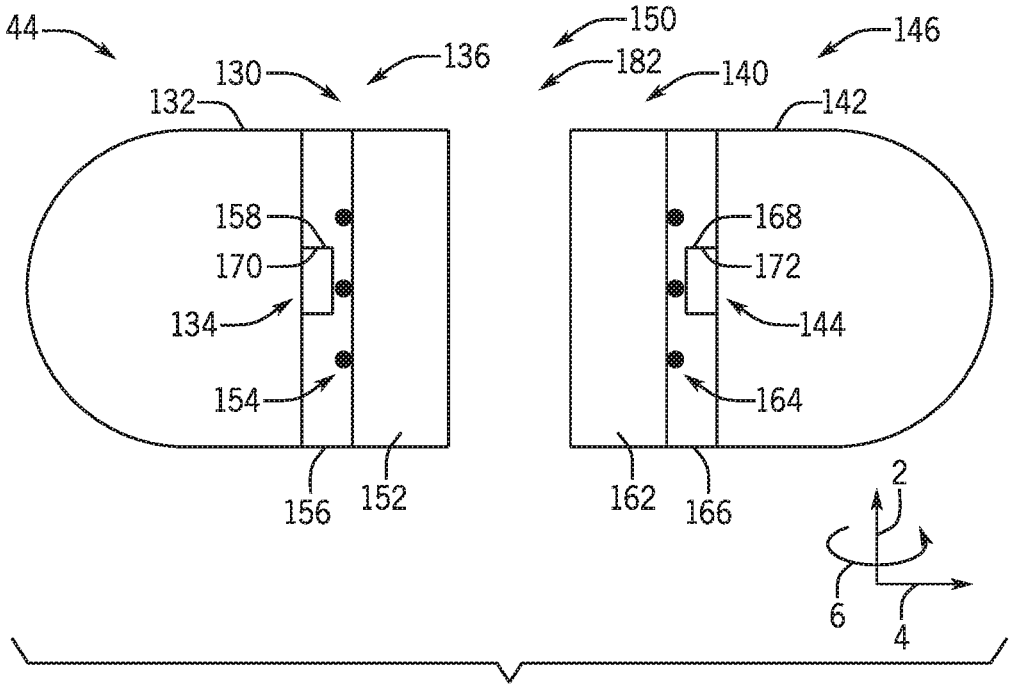
FIG. 6 is a cross-sectional side view of the portion of the RCD system of FIG. 5, wherein the seal element assembly is in an engaged configuration, in accordance with an embodiment of the present disclosure.

In FIG. 5, the seal element assembly 150 formed by the first packer assembly 130 and the second packer assembly 140 is in a disengaged configuration 180 in which the first packer assembly 130 is not coupled to the first ram 132 and the second packer assembly 140 is not coupled to the second ram 142. In FIG. 6, the seal element assembly 150 formed by the first packer assembly 130 and the second packer assembly 140 is in an engaged position 182 in which the first packer assembly 130 is coupled to the first ram 132 via the stab connection 134 to form the first ram assembly 136, and the second packer assembly 140 is coupled to the second ram 142 via the stab connection 144 to form the second ram assembly 146.

Figure 7:
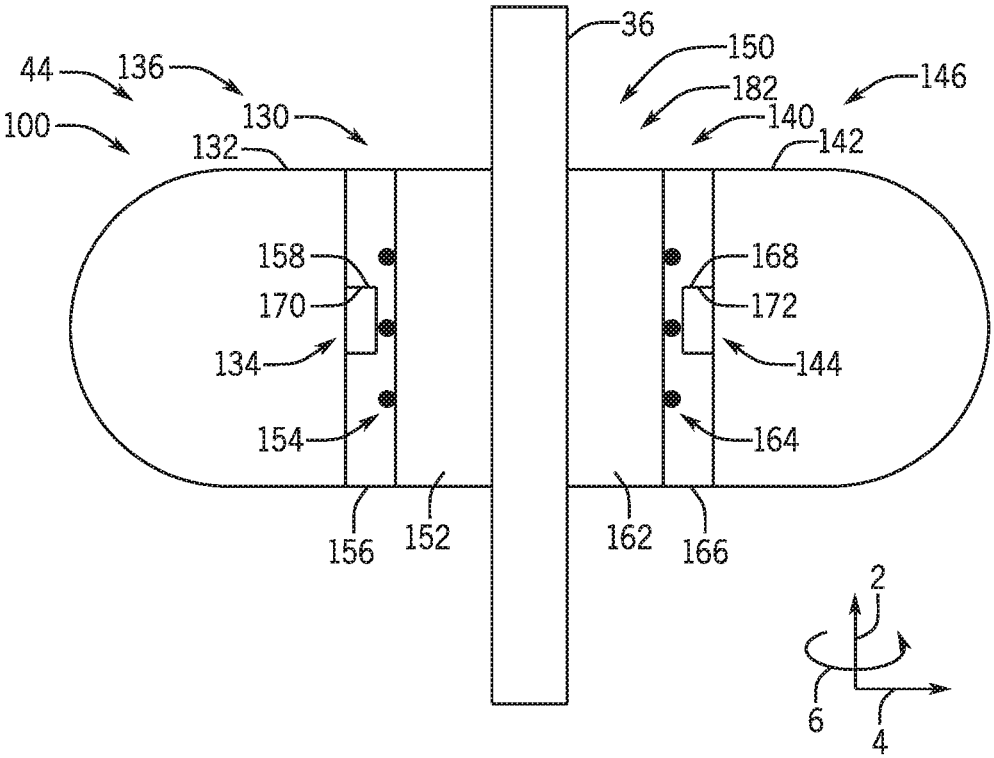
FIG. 7 is a cross-sectional side view of the portion of the RCD system of FIG. 5, wherein the RCD system is in a closed configuration, in accordance with an embodiment of the present disclosure.

Furthermore, FIG. 7 is a cross-sectional side view of the portion of the RCD system 44 of FIG. 5, wherein the RCD system 44 is in the closed configuration 100 in which the seal element assembly 150 seals against the tubular 36. As shown in FIGS. 5-7, the first packer assembly 130 may include the first bearing 154 to enable the first packer 152 to rotate relative to the frame 156 of the first packer assembly 130 and/or relative to the first ram 132 and the second packer assembly 140 may include the second bearing 164 to enable the second packer 162 to rotate relative to the frame 166 of the second packer assembly 140 and/or relative to the second ram 142. To move to the closed configuration 100 of FIG. 7, the first ram assembly 136 and the second ram assembly 146 may be driven into the bore along the longitudinal axis 4 via actuators.

It should be appreciated that the first packer 152 and the second packer 162 may each have an arc shape in a cross-section taken in a plane parallel to the longitudinal axis 4 (e.g., from a top view), similar to or the same as the arc shape illustrated in FIGS. 2-4. Furthermore, the first ram 132 and the second ram 142 may have a corresponding curved shaped (e.g., radially-inner curved surface) to mate with the first packer assembly 130 and the second packer assembly 140, respectively. While the first packer assembly 130 and the first ram 132, as well as the second packer assembly 140 and the second ram 142, are not shown to have a corresponding taper along the vertical axis 2 (e.g., similar to FIG. 4), it should be appreciated that the components may be modified to provide the corresponding taper or similar interface (e.g., stepped interface) to provide further support to the first packer assembly 130 and the second packer assembly 140 along the vertical axis 2.

The first packer assembly 130 and the second packer assembly 140 may be separated from the first ram 132 and the second ram 142, respectively, via the tool. For example, as the tool engages the first packer assembly 130 and the second packer assembly 140, the first ram 132 and the second ram 142 may be retracted or withdrawn from the bore via the actuators to thereby break the stab connections. The tool may then pull the first packer assembly 130 and the second packer assembly 140 along the vertical axis 2 away from the first ram 132 and the second ram 142.

In some embodiments, the RCD system of FIGS. 5-7 may include one or more retaining features (e.g., shear pins, actuatable locks) similar to the one more retaining features discussed above with respect to FIGS. 2-4. In such cases, the one or more retaining features may be incorporated into the first packer assembly 130 and the second packer assembly 140 (e.g., extend radially between the respective frame 156, 166 and the respective packer 152, 162) to block rotation of the first packer 152 and the second packer 162 until the one or more retaining features are removed (e.g., via shearing due to rotation of the tubular 36; via actuation). Thus, in some embodiments, the RCD system 44 may be configured to operate to seal about the tubular 36 without rotation of the first packer 152 or the second packer 162 relative to the first ram 132 and the second ram 142 (e.g., the RCD system 44 may operate as a BOP having pipe rams that seal against the tubular 36 without rotation of the first packer 152 or the second packer 162 relative to the first ram 132 and the second ram 142). This may be particularly useful during drilling operations or other types of operations in which the tubular 36 does not rotate within the bore; however, this may be useful regardless of whether the tubular 36 rotates within the bore. It should be appreciated that the one or more retaining features may have any suitable form to enable the disclosed techniques.

Furthermore, the stab connections 134, 144 may facilitate efficient transition of the RCD system 44 for use as an RCD device (e.g., having the seal element assembly 150 that seals about and rotates with the tubular 36) and for use as a BOP (e.g., having a seal element that seals the bore without rotation of the seal element). For example, upon removal of the first packer assembly 130 and the second packer assembly 140, the first ram 132 and the second ram 142 may be used as the BOP. In some such cases, the first ram 132 and the second ram 142 may be configured to couple (e.g., via the respective stab features 170, 172) to additional packer assemblies that are configured to enable such operations or any of a variety of other operations. In some embodiments, the change in the packer assemblies may be carried out at the wellsite and without removal of the first ram 132 and the second ram 142 from the housing of the RCD system 44.

Figure 8:
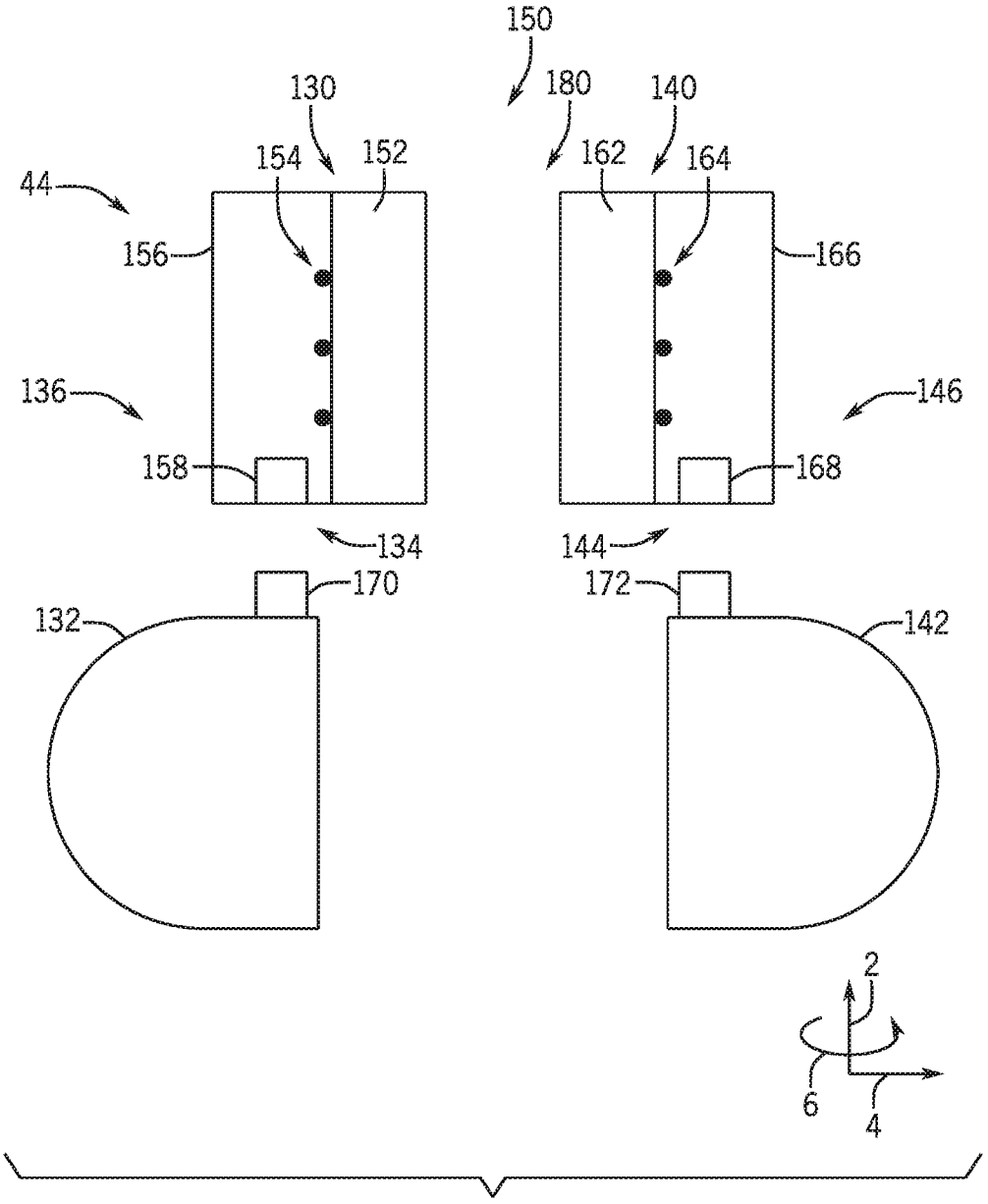
FIG. 8 is a cross-sectional side view of a portion of an RCD system that may be used in the drilling system of FIG. 1, wherein a seal element assembly is in a disengaged configuration, in accordance with an embodiment of the present disclosure.

FIG. 8 is a cross-sectional side view of a portion of the RCD system 44 that may be used in the drilling system of FIG. 1. In FIG. 8, the first packer assembly 130 is configured to couple to the first ram 132 via the first stab connection 134 (e.g., key-slot connection) to form the first ram assembly 136, and the second packer assembly 140 is configured to couple to the second ram 142 via the second stab connection 144 (e.g., key-slot connection) to form the second ram assembly 146. Together, the first packer assembly 130 and the second packer assembly 140 form the seal element assembly 150.

As shown, the first stab connection 134 is formed between vertically-facing surfaces of the first packer assembly 130 and the first ram 132, and the second stab connection 144 is formed between vertically-facing surfaces of the second packer assembly 140 and the second ram 142. The first packer assembly 130 and the second packer assembly 140 may be assembled onto the first ram 132 and the second ram 142, respectively, during manufacturing operations prior to installation of the RCD system 44 at a wellsite or at the wellsite. For example, to assemble the components at the wellsite, the first ram 132 and the second ram 142 may be driven toward and positioned in the bore. Then, the first packer assembly 130 and the second packer assembly 140 may be lowered into the bore via a tool (e.g., running tool; installation tool) until the first packer assembly 130 and the second packer assembly 140 are stabbed into the first ram 132 and the second ram 142 along the vertical axis 2.

Figure 9:
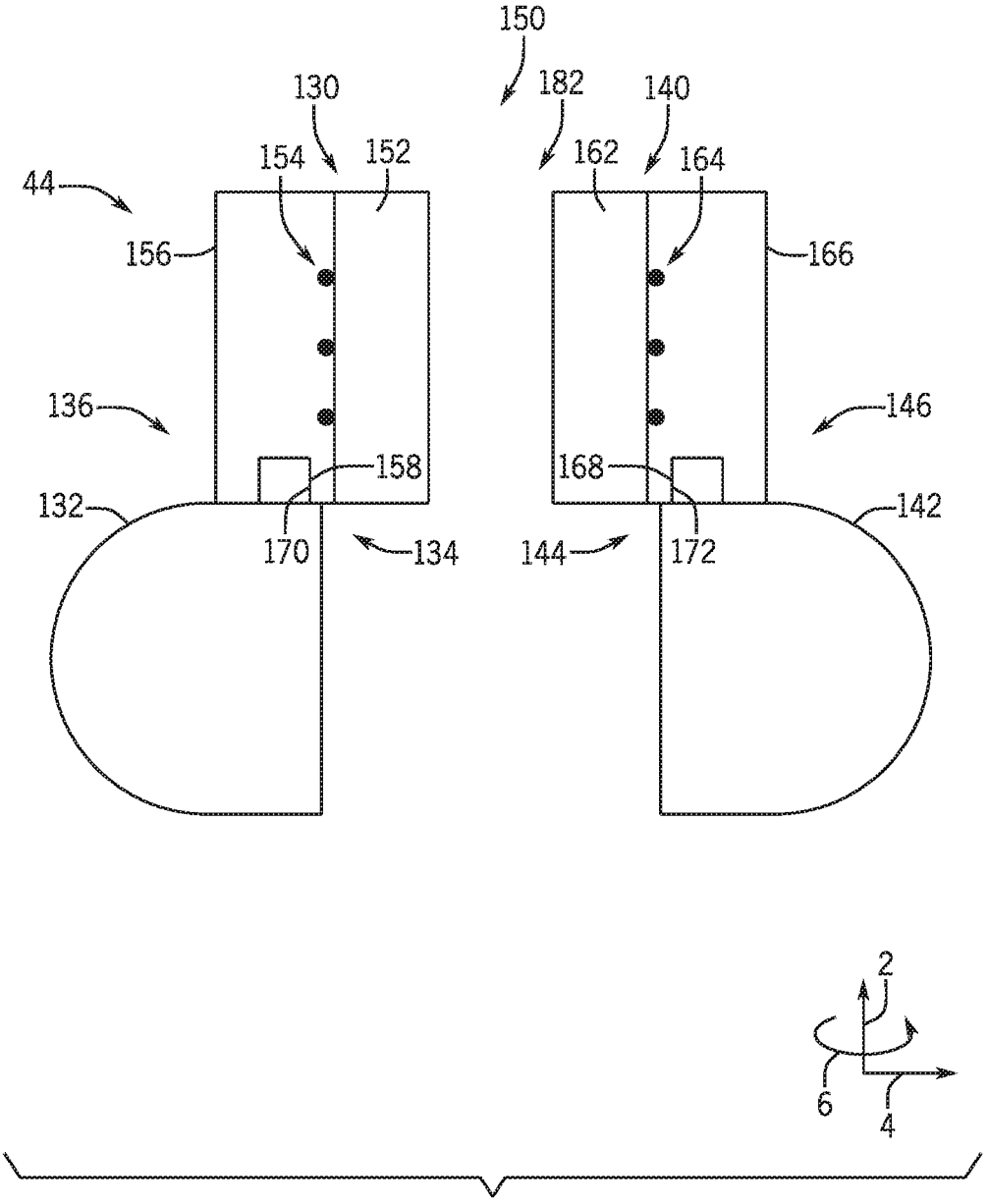
FIG. 9 is a cross-sectional side view of the portion of the RCD system of FIG. 8, wherein the seal element assembly is in an engaged configuration, in accordance with an embodiment of the present disclosure.

In FIG. 8, the seal element assembly 150 formed by the first packer assembly 130 and the second packer assembly 140 is in the disengaged configuration 180 in which the first packer assembly 130 is not coupled to the first ram 132 and the second packer assembly 140 is not coupled to the second ram 142. In FIG. 9, the seal element assembly 150 formed by the first packer assembly 130 and the second packer assembly 140 is in the engaged position 182 in which the first packer assembly 130 is coupled to the first ram 132 via the stab connection 134 to form the first ram assembly 136, and the second packer assembly 140 is coupled to the second ram 142 via the stab connection 144 to form the second ram assembly 146.

Figure 10:
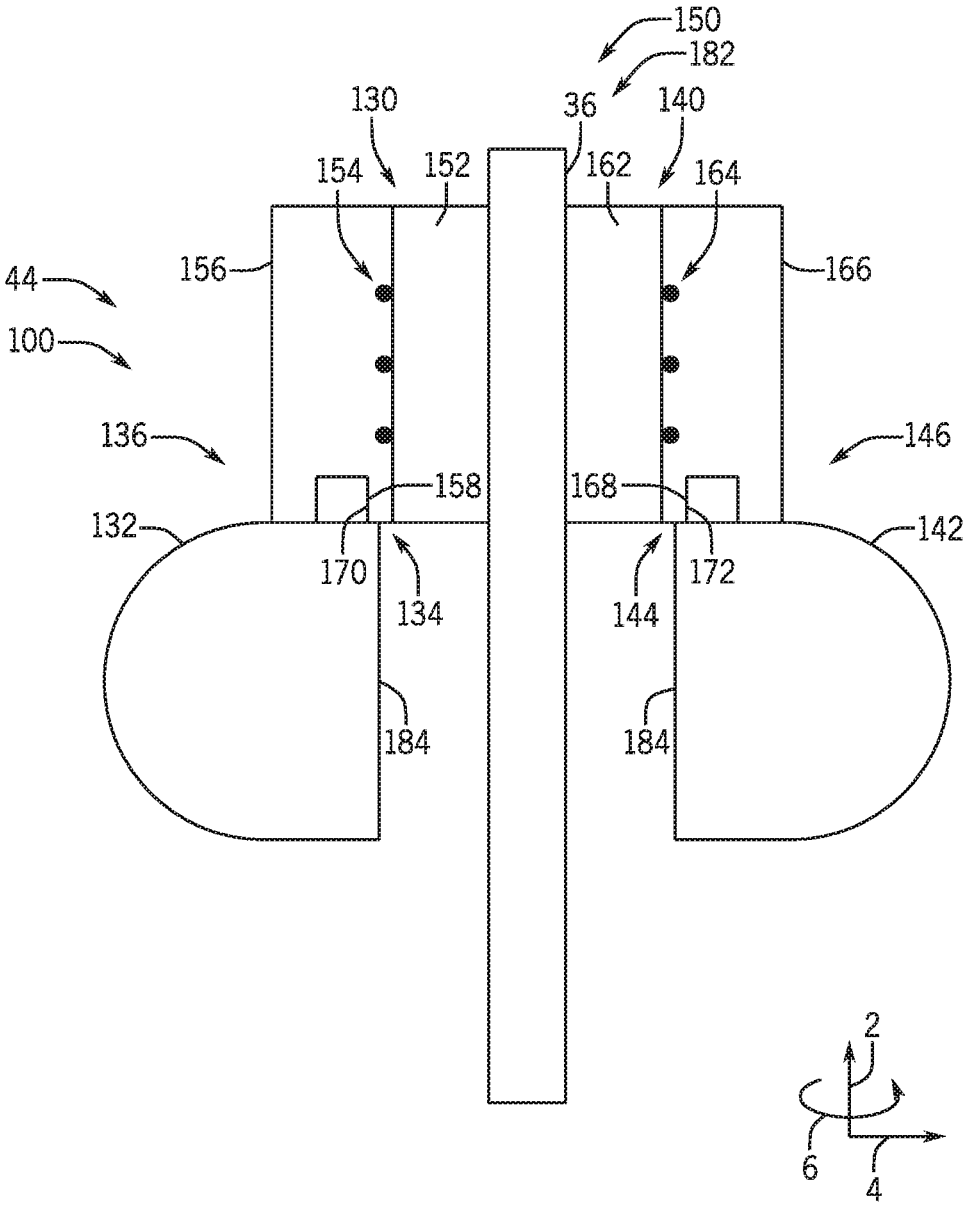
FIG. 10 is a cross-sectional side view of the portion of the RCD system of FIG. 8, wherein the RCD system is in a closed configuration, in accordance with an embodiment of the present disclosure.

FIG. 10 is a cross-sectional side view of the portion of the RCD system 44 of FIG. 8, wherein the RCD system 44 is in the closed configuration 100 in which the seal element assembly 150 seals against the tubular 36. As shown in FIGS. 8-10, the first packer assembly 130 may include the first bearing 154 to enable the first packer 152 to rotate relative to the frame 156 of the first packer assembly 130 and/or relative to the first ram 132 and the second packer assembly 140 may include the second bearing 164 to enable the second packer 162 to rotate relative to the frame 166 of the second packer assembly 140 and/or relative to the second ram 142. To move to the closed configuration 100 of FIG. 10, the first ram assembly 136 and the second ram assembly 146 may be driven into the bore along the longitudinal axis 4 via actuators.

It should be appreciated that the first packer 152 and the second packer 162 may each have an arc shape in a cross-section taken in a plane parallel to the longitudinal axis 4 (e.g., from a top view), similar to or the same as the arc shape illustrated in FIGS. 2-4. Furthermore, the first ram 132 and the second ram 142 may have a corresponding curved shaped (e.g., radially-inner curved surface) to mate with the first packer 152 and the second packer 162, respectively. While the first packer assembly 130 and the first ram 132, as well as the second packer assembly 140 and the second ram 142, are not shown to have a corresponding taper along the vertical axis 2 (e.g., similar to FIG. 4), it should be appreciated that the components may be modified to provide the corresponding taper or a similar interface (e.g., stepped interface, such that a portion of the first ram 132 is circumferentially about the first packer assembly 130 when connected to one another and a portion of the second ram 142 is circumferentially about the second packer assembly 140 when connected to one another) to provide further support to the first packer assembly 130 and the second packer assembly 140 along the vertical axis 2 and/or the longitudinal axis 4. The first packer assembly 130 and the second packer assembly 140 may be separated from the first ram 132 and the second ram 142, respectively, via the tool. For example, the tool may engage and pull the first packer assembly 130 and the second packer assembly 140 along the vertical axis 2 away from the first ram 132 and the second ram 142.

In some embodiments, the RCD system of FIGS. 8-10 may include one or more retaining features (e.g., shear pins, actuatable locks) similar to the one more retaining features discussed above with respect to FIGS. 2-4. In such cases, the one or more retaining features may be incorporated into the first packer assembly 130 and the second packer assembly 140 (e.g., extend radially between the respective frame 156, 166 and the respective packer 152, 162) to block rotation of the first packer 152 and the second packer 162 until the one or more retaining features are removed (e.g., via shearing upon rotation of the tubular 36; via actuation). Thus, in some embodiments, the RCD system 44 may be configured to operate to seal about the tubular 36 without rotation of the first packer 152 or the second packer 162 relative to the first ram 132 and the second ram 142 (e.g., the RCD system 44 may operate as a BOP having pipe rams that seal against the tubular 36 without rotation of the first packer 152 or the second packer 162 relative to the first ram 132 and the second ram 142). This may be particularly useful during drilling operations or other types of operations in which the tubular 36 does not rotate within the bore; however, this may be useful regardless of whether the tubular 36 rotates within the bore. It should be appreciated that the one or more retaining features 108 may have any suitable form to enable the disclosed techniques.

Furthermore, the stab connections may facilitate efficient transition of the RCD system 44 for use as an RCD device (e.g., having the seal element assembly 150 that seals about and rotates with the tubular 36) and for use as a BOP (e.g., having a seal element that seals the bore without rotation of the seal element). For example, upon removal of the first packer assembly 130 and the second packer assembly 140, the first ram 132 and the second ram 142 may be used as the BOP. In some such cases, the first ram 132 and the second ram 142 may be configured to couple (e.g., via the respective stab features 170, 172) to additional packer assemblies that are configured for such operations. In some cases, the first ram 132 and the second ram 142 may each have a BOP packer (e.g., at surfaces 184 of the first ram 132 and the second ram 142 that face the bore) that is positioned so that the first packer assembly 130 and the second packer assembly 140 do not interfere with the BOP packers even while the first packer assembly 130 and the second packer assembly 140 are coupled to the first ram 132 and the second ram 142, respectively.

Figure 11:
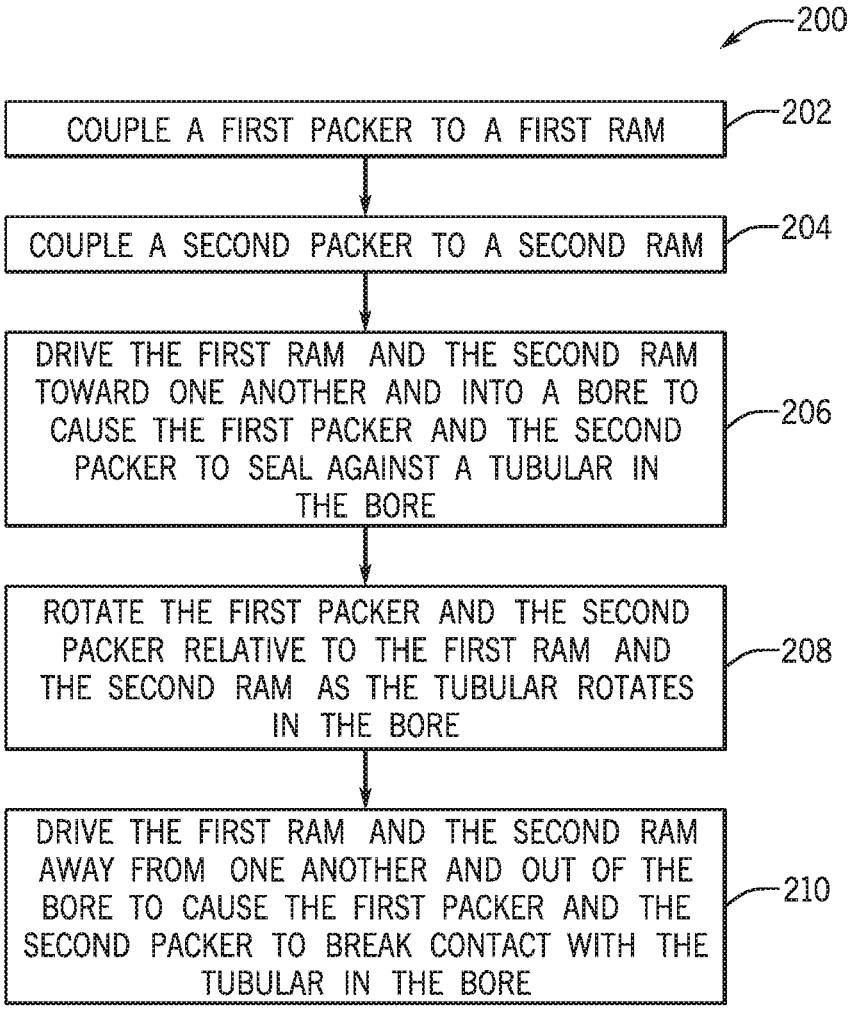
FIG. 11 is a flow diagram of a method of operating an RCD system that may be used in the drilling system of FIG. 1, in accordance with an embodiment of the present disclosure.

FIG. 11 is a flow diagram of an embodiment of a method 200 of operating an RCD system, such as the RCD system 44, that may be used in the drilling system of FIG. 1. In step 202, a first packer may be coupled to a first ram of the RCD system. The first packer and the first ram may form a first ram assembly. The first packer and the first ram may be coupled to one another in any of a variety of ways, such as via a corresponding taper or other interface formed by corresponding surfaces (e.g., stepped surfaces), one or more retaining features, and/or a stab connection.

In step 204, a second packer may be coupled to a second ram of the RCD system. The second packer and the second ram may form a second ram assembly. The second packer and the second ram may be coupled to one another in any of a variety of ways, such as via a corresponding taper or other interface formed by corresponding surfaces, one or more retaining features, and/or a stab connection.

In step 206, the first ram (and the first packer coupled thereto) and the second ram (and the second packer coupled thereto) may be driven toward one another and into a bore to cause the first packer and the second packer to seal (e.g., to form an annular seal) against a tubular in the bore.

In step 208, the first packer and the second packer may rotate relative to the first ram and the second ram as the tubular rotates. For example, the first packer and the second packer may be supported on bearings that enable such rotation. As noted above, such rotation may be initially blocked (e.g., via shear pins) or selectively blocked (e.g., via actuatable locks), and any of a variety of one or more retaining features may be utilized to block or to otherwise limit the rotation of the first packer and the second packer.

In step 210, the first ram (and the first packer coupled thereto) and the second ram (and the second packer coupled thereto) may be driven away from one another (e.g., withdrawn) and out of the bore to cause the first packer and the second packer to break contact (e.g., to break the annular seal) against the tubular in the bore. In some embodiments, the first packer and the second packer may be separated from the first ram and the second ram, respectively, such as via a tool. However, in some embodiments, the first packer and the second packer may remain in place for future RCD operations. In some embodiments, the first ram and the second ram may be coupled to (e.g., at the same time as the first packer and the second packer, or only at different times as the first packer and the second packer) additional packers that may be used for future BOP operations. For example, the additional packers, the first packer, and the second packer may be coupled to the first ram and the second ram using the same connections (e.g., the same stab features) or different connections.

It should be appreciated that all of the features discussed above with respect to FIGS. 1-11 may be combined in any suitable manner. Additionally, various modifications are envisioned. For example, while the seal element and the seal element assembly are illustrated as two physically separate components that are independently coupled to a respective ram, the seal element or the seal element assembly may be an annular component (e.g., gaplessly continuous ring) and the rams may compress the annular component (e.g., reduce an inner diameter of the annular component) to adjust the seal about the tubular 36.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is intended to cover all modifications, equivalents, and alternatives falling within the spirit and scope of the disclosure as defined by the following appended claims.

The invention claimed is:

1. A rotating control device (RCD) system, comprising:

a housing comprising a bore;

a first ram assembly supported in the housing, wherein the first ram assembly comprises a first ram and a first packer coupled to the first ram;

a second ram assembly supported in the housing, wherein the second ram assembly comprises a second ram and a second packer coupled to the second ram; and a bearing assembly configured to enable the first packer and the second packer to rotate relative to the first ram and the second ram, an actuator assembly configured to drive the first ram assembly and the second ram assembly toward one another to adjust the RCD system to a closed configuration in which the first packer and the second packer form an annular structure that is configured to seal about a tubular within the bore.

2. The RCD system of claim 1, wherein the bearing assembly is configured to enable the first packer and the second packer to rotate in a circumferential direction about the bore.

3. The RCD system of claim 1, wherein the first packer and the second packer are configured to form an annular seal about a tubular within the bore.

4. The RCD system of claim 1, wherein the first packer and the second packer each comprise an arc cross-sectional shape.

5. The RCD system of claim 1, wherein a radially-inner curved surface of the first ram and a radially-outer curved surface of the first packer comprise a corresponding taper.

6. The RCD system of claim 1, wherein the first ram and the first packer are coupled to one another via a stab connection.

7. The RCD system of claim 1, comprising a first packer assembly, wherein the first packer assembly comprises the first packer, a first bearing of the bearing assembly, and a first stab feature, and wherein the first packer assembly is configured to couple to the first ram via the first stab feature to form the first ram assembly.

8. The RCD system of claim 7, wherein the first stab feature is positioned on an outer surface of the first packer assembly to enable the first packer assembly to couple to a second stab feature on an inner surface of the first ram.

9. The RCD system of claim 1, comprising one or more retaining features that are configured to block rotation of the first packer and the second packer relative to the first ram and the second ram.

10. The RCD system of claim 9, wherein the one or more retaining features comprise shear pins that are configured to shear in response to a rotational force exerted on the first packer and the second packer.

11. The RCD system of claim 9, wherein the one or more retaining features comprise actuatable locks that are adjustable to an unlocked configuration to enable rotation of the first packer and the second packer in response to the RCD system being driven toward or reaching a closed configuration.

12. A rotating control device (RCD) system, comprising:

a housing comprising a bore;

a first ram assembly comprising a first ram and a first packer rotatably coupled to the first ram;

a second ram assembly comprising a second ram and a second packer rotatably coupled to the second ram; and an actuator assembly configured to drive the first ram and the second ram toward one another to adjust the RCD system to a closed configuration in which the first packer and the second packer form an annular structure that is configured to seal about a tubular within the bore.

13. The RCD system of claim 12, comprising a bearing assembly configured to rotatably couple the first packer to the first ram and to rotatably couple the second packer to the second ram.

14. The RCD system of claim 12, wherein the first packer and the second packer are configured to rotate together as the annular structure in a circumferential direction about the bore.

15. The RCD system of claim 12, wherein the first ram and the first packer are coupled to one another via a stab connection.

16. The RCD system of claim 12, comprising one or more retaining features that are configured to block rotation of the first packer and the second packer relative to the first ram and the second ram.

17. A method of operating a rotating control device (RCD) system, the method comprising:

driving a first ram assembly and a second ram assembly toward one another to adjust the RCD system to a closed configuration in which a first packer of the first ram assembly and a second packer of a second ram assembly contact one another to form an annular seal about a tubular within a bore; and rotating the first packer and the second packer relative to a first ram body of the first ram assembly and a second ram body of the second ram assembly as the tubular rotates within the bore.

18. The method of claim 17, comprising:

coupling the first packer and the second packer to a running tool;

lowering the first packer and the second packer toward a well using the running tool; and bringing the first packer into contact with the first ram to form the first ram assembly and the second packer into contact with the second ram to form the second ram assembly.

* * * * *